United States Patent [19]

Ishikawa

[11] 4,448,515

[45] May 15, 1984

[54] CONTROL ARRANGEMENT FOR CONTINUOUS COPYING

[75] Inventor: Takuma Ishikawa, Toyokawa, Japan

[73] Assignee: Minolta Camera Kabushiki Kaisha, Osaka, Japan

[21] Appl. No.: 390,563

[22] Filed: Jun. 21, 1982

[30] Foreign Application Priority Data

Jun. 27, 1981 [JP] Japan ..... 56-99894

[51] Int. Cl.[3] ..... G03G 15/00

[52] U.S. Cl. ..... 355/14 R; 355/3 R; 355/3 SH; 355/14 C; 355/14 SH; 355/14 CU

[58] Field of Search ..... 355/14 R, 14 C, 3 R, 355/14 CU, 3 SH, 14 SH

[56] References Cited

U.S. PATENT DOCUMENTS 3,936,180 2/1976 Willard et al. ..... 355/14

4,344,697 8/1982 Matsumoto et al. ..... 355/14 C

FOREIGN PATENT DOCUMENTS 55-164841 12/1980 Japan .

*Primary Examiner*—A. C. Prescott

*Attorney, Agent, or Firm*—Jackson, Jones & Price

[57] ABSTRACT

A copying control arrangement for controlling functioning of a copying apparatus having a multi-copying mode to effect a continuous copying. The control arrangement includes a first switch for starting ordinary copying functioning, a second switch for causing the copying apparatus to function in a trial copy mode, a timer for starting subsequent copying function after lapse of a predetermined period of time subsequent to termination of copying functioning when the copying functioning is executed in the trial copy mode, and a control device for starting the ordinary copying functioning selectively by time-up signal of the timer or by start signal from the first switch during timer functioning of the timer.

9 Claims, 11 Drawing Figures

CONTROL ARRANGEMENT FOR CONTINUOUS COPYING

BACKGROUND OF THE INVENTION

The present invention generally relates to a copying apparatus and more particularly, to a copying control arrangement to be applied, for example, to a transfer type copying cycle apparatus in a continuous copying, which is intended to achieve favorable quality in all copies, and this is accomplished by processing a first copied sheet from the continuous copying cycle for the purpose of inspection, so as not to produce faulty copied items (referred to as copied sheets hereinbelow) when such continuous copying mode has been selected.

At present, when a large number of copies are to be taken from an original or original document to be copied, for example, in an electrophotographic copying apparatus (referred to merely as copying apparatus hereinbelow) currently available, it is so arranged that the predetermined number of copies to be taken is preset in advance for obtaining the required number of copied sheets through a continuous copying mode (referred to as "multi-mode" hereinbelow).

However, in the known copying apparatus as described above, if the multi-mode copying is directly effected, it may result in an excessive waste of time or copying materials. In other words, in the above practice, there may be cases where all the copied sheets can not always be obtained with the quality desired, depending on the set position or image density of the original document to be copied, condition of the copying apparatus, and particularly, on the state of system related to toner, etc. Such inconvenience or waste as described above is attributable to the fact that, for judging the quality of copied images, there is no other way at present than to evaluate the image quality of the copied sheets through visual examination after the copying cycle.

Such being the case, it may be a normal procedure adopted by machine operators, to take only one copy initially by use of a mode for copying only one sheet (referred to as "single mode" hereinbelow) even when a large number of copies are to be obtained, and to change over to the multi-mode, if the image quality of such initial one sheet is found to be satisfactory.

However, the method as described above still has some drawbacks as follows. More specifically, the procedure forces an operator to carry out two stages of operations, i.e. the single mode operation and subsequent multi-mode operation, and when the practice is combined with a sorter (or collator), it is extremely inconvenient, since two sheets for the same copy are to be fed into a first bin of the sorter.

In connection with the above, Japanese Laid Open Patent Application Tokkaisho No. 55-164841 proposed to particularly eliminate the latter inconvenience, this is accomplished by an arrangement in which the first copied sheet is necessarily discharged onto the side of a tray, even when the sorter is selected.

The known arrangement as described above has disadvantages in that, since even a copied sheet of good quality is undesirably discharged onto the tray at all times, there is an inconvenience for collation, while, owing to the fact that standing-by for the predetermined period of time is required even when correction of a copied image is unnecessary in the multi-mode copying, loss of the time is necessarily involved, thus resulting in a double drawback. U.S. Pat. No. 3,936,180 is cited of general interest to disclose the capacity of providing a sample page during a normal operating cycle.

SUMMARY OF THE INVENTION

Accordingly, an essential object of the present invention is to provide a copying control arrangement in a continuous copying mode of operation, for example, to a copying apparatus and the like, in which correction of a first copied sheet is effected in a rational manner for carrying out copying in a multi-mode, so as to obtain all copied sheets with high quality at all times.

Another object of the present invention is to provide a copying control arrangement as described above which is simple in construction and efficient in operation, and can be readily incorporated into copying apparatuses and the like at low cost.

According to the present invention, it is preferably so arranged that, in a copying apparatus system in which a sorter and a copying apparatus main body is coupled to each other almost into one unit, correction processing of a first copied sheet is rationally effected for executing the multi-mode copying.

It is more preferably arranged in such a manner that, in a copying apparatus system in which a copying apparatus main body and an independent type sorter for collating copied sheets to be discharged through a transport passage are combined with each other, correction processing of the first copied sheet is rationally effected for executing the multi-mode copying.

It is still more preferably arranged that, also in a copying apparatus equipped with an original document automatic feeding device (i.e. so-called auto-feeder) which requires no manual handling for setting the original to be copied, the multi-mode copying can be effected in a rational manner.

In accomplishing these and other objects, according to one preferred embodiment of the present invention, it is so arranged that, in a copying apparatus having a multi-copying mode for effecting a continuous copying function in correspondence with numerical values preliminarily set therein, there is provided a control arrangement for controlling functioning of the copying apparatus which includes a first switching means for starting ordinary copying functioning, a second switching means for causing the copying apparatus to function in a trial copy mode, a timer means for starting a subsequent copying function after a lapse of a predetermined period of time subsequent to termination of a copying functioning when the copying functioning is executed in the trial copy mode, and a control means for starting the ordinary copying functioning selectively by a time-up signal of the timer means or by a start signal from the first switching means during timer functioning of the timer means.

By the construction according to the present invention as described above, an improved copying control arrangement has been advantageously presented, with substantial elimination of disadvantages inherent in the conventional arrangement of this kind.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
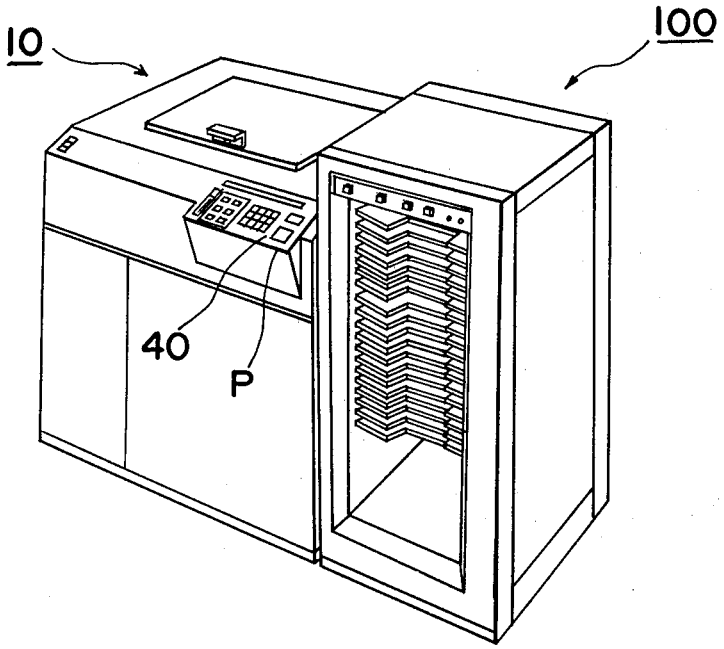
FIG. 1 is a perspective view of a copying apparatus system equipped with a sorter, to which a copying control arrangement according to one preferred embodiment of the present invention may be applied.
Figure 2:
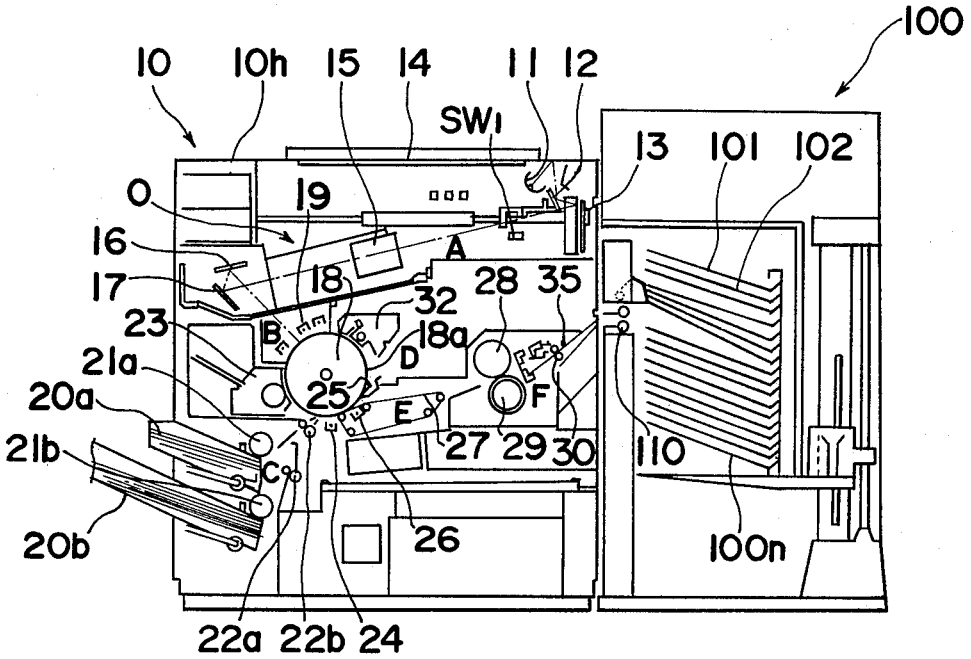
FIG. 2 is a schematic side sectional view of the copying apparatus system of FIG. 1.

Referring now to the drawings, there is shown in FIGS. 1 and 2 a copying apparatus system including a sorter 100 combined with a copying apparatus 10, to which a copying control arrangement for a continuous copying according to the present invention may be applied.

In FIGS. 1 and 2, the electrophotographic copying apparatus 10 of an optical system moving slit exposure type includes an original document platform 14 of a transparent material such as glass or the like fixedly provided on an upper portion of a housing 10*h* of the copying apparatus 10 so as to place an original document (not shown) to be copied on said platform 14, an optical system O provided below the original platform 14 and having a light source 11, a set of reflecting mirrors 12 and 13, an image forming lens 15 and another set of reflecting mirrors 16 and 17, and a photosensitive or photoreceptor drum 18 having a photosensitive surface layer 18*a* formed on the outer peripheral surface thereof and rotatably mounted at a generally central portion of the apparatus housing 10*h* so as to sequentially pass various processing devices such as a corona charger 19, a developing device 23, a transfer charge 24, an erasing charger 26, a cleaning device 32, etc. disposed thereabouts in a known manner.

More specifically, the light source 11 and reflecting mirrors 12 and 13 are capable of scanning as one unit towards the left in FIG. 2 upon reception of a rotational force of a driving motor (not shown) transmitted thereto through an electromagnetic clutch, etc. (not shown), and constitute a scanning mechanism A arranged to start the copying operation by actuating a switch SW1 such as a lead switch or the like provided in a predetermined position along the scanning path thereof.

The original document (not shown) placed on the original platform 14 is continuously illuminated by the light source 11, and light reflected from the original document is directed onto the photosensitive surface 18*a* through the reflecting mirrors 12 and 13, image forming lens 15, and reflecting mirrors 16 and 17 as indicated by chain lines in FIG. 2 for image exposure. Meanwhile, the photoreceptor drum 18 driven for rotation in the counterclockwise direction in FIG. 2 by the driving force of the driving motor transmitted thereto through the electromagnetic clutch as described earlier is preliminarily charged uniformly by the corona charger 19 on the photosensitive surface 18*a* thereof for the subsequent image exposure by the optical system in the above described manner so as to form an electrostatic latent image of the original document on said surface 18*a*. The electrostatic latent image thus formed is developed by the developing device 23 into a visible toner image. Accordingly, the photoreceptor drum 18, corona charger 19, and developing device 23, etc. constitute an image forming mechanism generally indicated at B.

On the other hand, at the left lower portion in FIG. 2, there is provided a copy paper feeding mechanism C which includes upper and lower copy paper cassettes 20*a* and 20*b* each accommodating therein copy paper sheets (not particularly shown) of predetermined sizes, and corresponding copy paper feeding rollers 21*a* and 21*b* provided for the respective cassettes 20*a* and 20*b* so as to be selectively rotated by the driving force of the driving motor for feeding the copy paper sheets, one by one, towards the lower portion of the photoreceptor drum 18 through transport rollers 22*a* and 22*b*, etc., whereat a transfer mechanism D including the transfer charger 24 transfers the visible toner image of the original document formed on the photosensitive surface 18*a*, for example, by a magnetic brush developing method, onto the copy paper sheet. The copy paper sheet subjected to the image transfer as described above is separated from the photoreceptor drum 18 by the separating claw 25, and is further fed to a fixing mechanism F through a copy paper transport mechanism E including a transport endless belt 27 which is supported by a plurality of support rollers driven by the driving force of the driving motor referred to earlier, and which has the charge erasing charger 26 incorporated therein. The fixing mechanism F includes a set of a heat roller 28 and a presser roller 29 provided in a position subsequent to the endless belt 27 for passing the copy paper sheet therebetween so as to fix the toner image onto said copy paper sheet through fusion by heat. Thereafter, the copy paper sheet thus processed for fixing is discharged through a pair of discharge rollers 30 and a copy discharge sensor 35, while the photoreceptor drum 18 is further rotated for a predetermined period of time so as to remove remaining toner from its photosensitive surface 18*a* by the cleaning device 32, and thus, one copying cycle is completed.

Meanwhile, the sorter 100 having a plurality of bins 101, 102, . . . and 100*n* is so arranged as to receive the copy paper sheets discharged through the discharge rollers 30 by a pair of receiving rollers 110, and to lead said copy paper sheets into a particular bin preliminarily designated. In other words, the sorter 100 is coupled with the copying apparatus 10 not only mechanically, but also electrically, especially in the control of the entire copying system as described in detail later.

Figure 3:
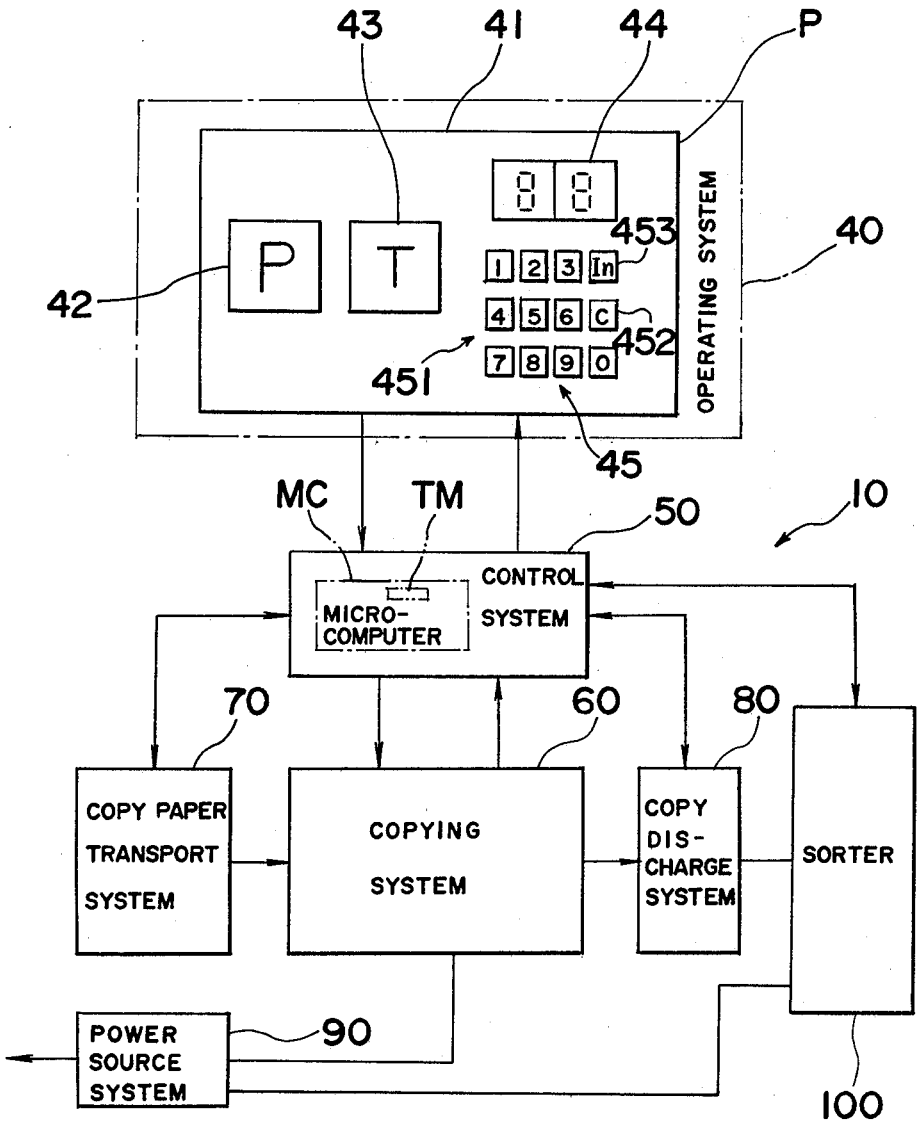
FIG. 3 is a block diagram showing a general construction of the copying apparatus system of FIG. 1, FIGS. 4(A) to 4(C) are flow charts explanatory of copying control in the copying apparatus system of FIG. 1.

Incidentally, the copying processing as described above is started by a control panel P (FIG. 1) for an operating system 40 provided at an upper front portion of the copying apparatus 10, and coupled with an electrical and electronic control system for said copying apparatus 10 as illustrated in FIG. 3.

In a block diagram of FIG. 3, the copying apparatus system according to the first embodiment of the present invention includes the operating system 40, a control system 50 including a micro-computer MC, a copying system 60, a copy paper transport system 70, a copy paper discharge system 80, the sorter 100 as shown in FIG. 2, and a power source system 90 for supplying proper power to each part of the copying apparatus 10 and also to the sorter 100, all of which are coupled to each other as shown.

In the operating system 40, an operating switch section 41 which is a particularly important section thereof, is provided with a print switch 42, a trial copy switch 43, a sheet number indicator 44 for displaying the number of copies to be taken, and an operating keyboard 45. The operating keyboard 45 further includes a numeric key or ten-key 451 having ten keys from 0 to 9 for setting the number of copy paper sheets to be taken, a clear key 452 for resetting the indication of the sheet number indicator 44 as set by the ten-key 451, and an interrupt key 453 for temporarily interrupting the continuous copying function (i.e. multi-copy mode). The sheet number indicator 44 is made, for example, of a seven segment element in this embodiment, for displaying the number of copy paper sheets to be taken from one original document as preliminarily set by the ten-key 451, in ten digits and one digit. The control panel P further includes a key for controlling the amount of exposure, a jamming display section for displaying copy paper jamming by illumination, and paper cut size change-over switches, etc., although these are not particularly shown.

The print switch 42 which is a first starting means of the copying function is operated for starting the single mode so as to take only one copied sheet from the original document, and also for starting the multi-mode in which a plurality of copied sheets are obtained from one original document through a continuous copying function, if the number of copies to be taken is preliminarily set.

The trial copy switch 43 serving as a second starting means is actuated for starting a trial multi-mode, which is a mode (multi-mode) for copying a plurality of copy paper sheets from one original document, and which is so arranged that, after discharging of a first copied sheet, a copying function subsequent to the first sheet may be continuously effected after lapse of a time period set by a timer as a time limiting means, and further that, upon actuation of a print switch 42 during the time period (i.e. before termination of the time period) set by the timer, copying operation subsequent to the first sheet may be immediately continued. For the timer referred to above, a timer TM incorporated in a micro-computer MC which controls almost all of the control functions in the control system 50 of the copying apparatus 10 is employed. The timer TM is a digital timer which performs the time limiting function by counting pulses of predetermined pulse intervals. In this case, the timer TM starts counting based on the functioning of the copy discharge sensor 35 provided immediately after the discharge rollers 30 in FIG. 1, and continues counting up to the lapse of a predetermined time period $T_1$ preliminarily set. The predetermined time period $T_1$ is a time period sufficient for effecting corrections by checking the copied sheet for its quality, and may be set on the basis of experiences. Upon lapse of the set time period (i.e. upon counting up), automatic control is effected by the micro-computer MC so that the copying function subsequent to the first sheet may be continuously effected. Meanwhile, if the control system 50 receives the signal that the print switch 42 is actuated during the set period of time (i.e. before counting up), preference is given to the copying operation, with the counting function of the timer TM neglected.

It should be noted that the counting time by the timer TM may be arranged to be displayed in the sheet number indicator referred to earlier under the control of the micro-computer MC, and also that the counting up by the timer MC may be adapted to notify an operator by sounds, for example, buzzer sounds, melody, or linguistic sounds by a voice synthesizer or the like.

The sorter 100 is capable of feeding or receiving control signals into or from the micro-computer MC of the control system 50 through a proper interface, and is perfectly under control of the micro-computer MC during execution of the copying functions. It is to be noted that the sorter 100 in this embodiment is of a type in which said sorter 100 is directly coupled with the copy discharge opening of the copying apparatus 10 so as to selectively guide the copied sheets into the bins thereof through rising or lowing of the sorter 100 itself, and in the case where one original document is to be continuously copied for "n" sheets in number, control is so effected that the copied sheets are successively fed into the first bin 101 to 100*n* bin (FIG. 2).

The general operations of the copying apparatus system described so far with reference to FIGS. 1 to 3 are as follows.

Upon actuation of the print switch 42, copying process is started in the known manner, and in the case where the sorter 100 is not provided, copying is processed either in the single mode or in the multi-mode. On the contrary, when the sorter 100 is provided, copied sheets in the predetermined number are successively discharged onto the first bin 101 to the "n"th bin 100*n*. If the trial copying switch 43 is operated prior to the print switch 42, preference is given to said print switch 42. In the above case, when the single mode is selected, the predetermined copying function is effected, and the copied sheet is discharged onto a copy paper discharge tray (not shown) or onto the top stage of the bins, i.e. the first bin 101. In other words, even in the case of the trial copying mode, the functioning is similar to the case of the ordinary one sheet copying, if the single mode is selected. Meanwhile, when the trial copying switch 43 is actuated in the multi-mode, only one sheet is first copied by the predetermined copying function. If the sorter 100 is provided, the copied sheet is discharged onto the first bin 101. In the above case, when the copied sheet has passed the discharge sensor 35, one is subtracted from the set number indicating the number of sheets to be copied, with simultaneous starting of the timer TM.

In the above state, the operator is to check the copied sheet for the quality of the copying, and effect necessary corrections, etc. before counting up by the timer TM. If the quality of the copying is favorable, the trial multi-mode is released upon actuation of the print switch 42 before the counting up by the timer TM, and copying process subsequent to the first sheet is continued. In the case where the sorter 100 is provided, copied sheets are to be discharged into the bin subsequent to the first bin 101. On the other hand, if the copying is found to be faulty and required to be checked again for its quality after necessary corrections thereof, the trial copying switch 43 is again actuated, and then, the timer TM is reset to provide the copy after the corrections through predetermined copying function. In this case, since the previous copy becomes unnecessary, copying function is effected under the state where the set number has been automatically returned to the original number. Accordingly, it is possible to repeat the corrections by any desired times, with the set number of sheets kept as it is, until a copy of satisfactory quality is obtained. It is to be noted here that, if both of the print switch 42 and trial copying switch 43 are not actuated before termination of the timer set time $T_1$, copying process subsequent to the first sheet is to be continued. It is also to be noted that, in the foregoing embodiment, although reference is mainly made to the copying apparatus system including the sorter 100, attention should be directed to the fact that the concept of the present invention is not limited in its application to the copying apparatus system equipped with the sorter 100 alone, but may readily be applied to a case where only the copying apparatus 10 is provided. In the absence of the sorter 100, copied sheets are discharged onto an ordinary discharge tray (not particularly shown).

Referring also to flow the charts of FIGS. 4(A) to 4(C), functionings of the arrangement of FIGS. 1 to 3 will be described in more detail hereinbelow. It should be noted that in the flow charts of FIGS. 4(A) to 4(C), each step is generally represented by an abbreviated symbol SP.

At a step SP1, initial settings are effected. In other words, such settings as the numeric setting of one, setting of magnification to equal size at 1:1, setting the mode to normal, or clearing of the random access memory RAM (incorporated in the micro-computer MC), etc. are effected by the data from the read only memory ROM for the initial settings.

At a step SP2, the key input of the ten-key 451, etc. is subjected to scanning, while, at a step SP3, indication output for indication at the sheet number indicator 44, etc. is given based on the result of the scanning at the step SP2.

At a step SP4 which is a judging step, judgement is made as to whether a copy flag FC is 0 or 1. If the copy flag FC=1, it means that the copying function is being carried out, and during this period, no starting inputs by the print switch PSW42 and trial copying switch TSW43 are accepted.

If the relation is FC=0 at the step SP4, the step proceeds to a subsequent step SP5, but if not FC=0 (i.e. if FC=1), the step branches to a step SP13. It is to be noted that in the flow charts of FIGS. 4(A) to 4(C), a symbol N represents NO, while another symbol Y denotes YES.

At the step SP5, judgment is made as to whether or not the print switch PSW42 is actuated, i.e. said print switch PSW42 is turned ON through depression thereof, with a rising of voltage. By the turning ON of the print switch PSW42, normal copying (in the single mode or multi-mode) after a step SP9 is initiated. In the case where the print switch PSW42 is not operated, the step is advanced to a step 6 for judgment as to whether or not the trial copying switch TSW43 is actuated. At the step SP6, the trial multi-mode is effected at and after a step SP7 by the turning ON. In the above case, similar to the step SP5, functioning depends on whether or not the micro-computer MC receives the signal for the voltage rising due to depression of the switch. If the judgment is of YES at the step SP6, a trial multi-mode flag FT is set to 1. Subsequently, at a step SP8, the timer TM is cleared, and a timer flag Ft is set to 0.

At the step SP9, the copy flag FC is set to 1 to indicate that the copying function is proceeding.

Meanwhile, at a step SP10, judgement is made as to whether or not the sorter 100 is coupled with the copying apparatus 10. As described earlier, it is so arranged that the electrical control relation is also established automatically therebetween by the above coupling. If the judgement is of YES at the step SP10, the step is advanced to a subsequent step SP11, while branching is effected to the step SP13, if the judgement is of NO.

Steps SP11 and SP12 are steps so arranged that the first bin 101 is initially selected upon execution of the copying function in the case where the sorter 100 is connected. Accordingly, in the first embodiment described so far, the first copied sheet in any of the multi-mode and trial multi-mode as well as the single mode, is necessarily guided into the first bin 101 of the sorter 100.

It should be noted here that the arrangement as described above may be modified in such a manner that the first sheet is discharged onto a discharge tray (not particularly shown) separately provided, and that the setting for the initial selection of the first bin is effected at the step SP1.

Meanwhile, steps SP13 and SP14 are judging steps for executing processing after a step SP36 by proceeding to a stage Ⓘ, during the mode which is not of the multi-mode (i.e. during the single mode) or the trial multi-mode. After the step SP36, processings for the normal copying function are effected. It is to be noted that, even when the mode is of the trial multi-mode in these steps, advancing to the trial mode is not particularly necessary in the case of a mere single mode. At the step SP14, if the trial copying flag FT equals 1, proceeding to a stage Ⓘ is effected.

Figure 4:
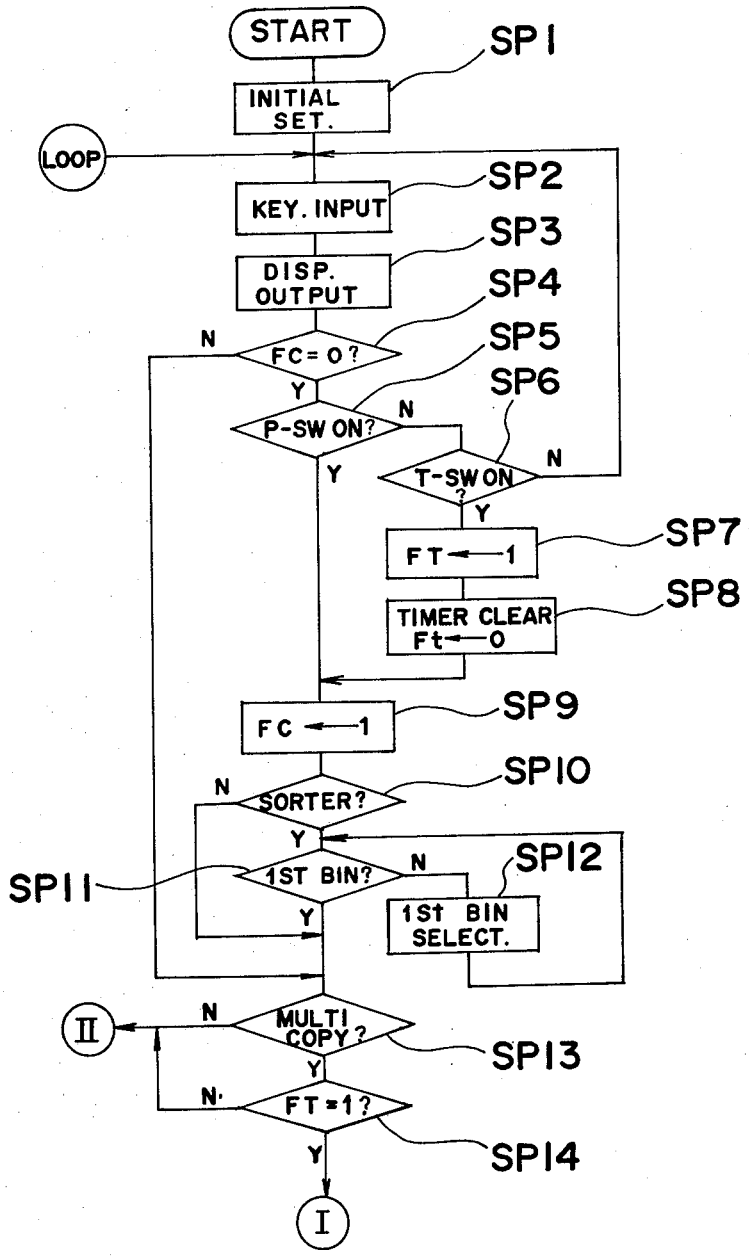
Figure 4:
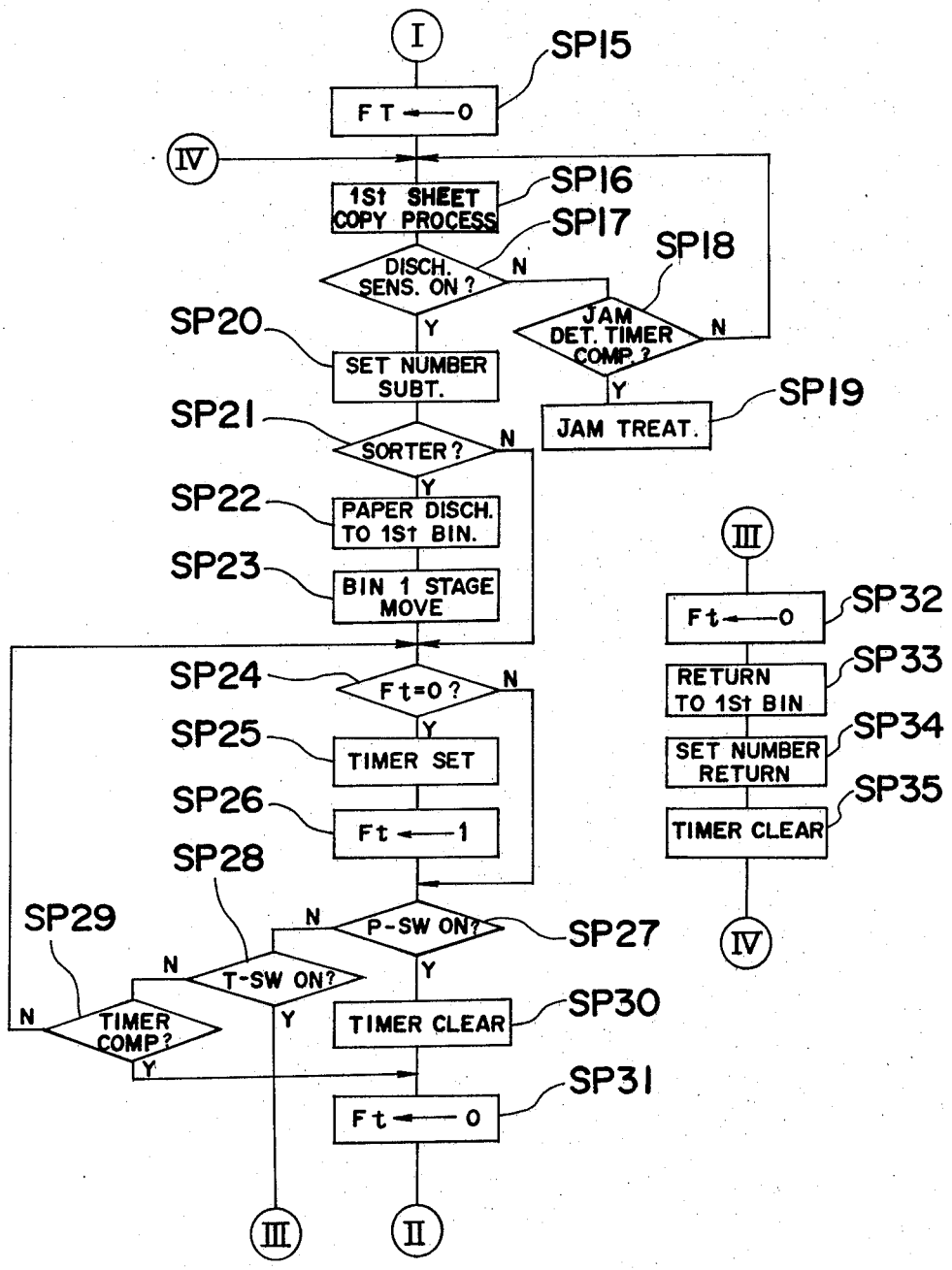

As shown in FIG. 4(B), in the processings after the stage Ⓘ, the trail multi-mode is executed. Firstly, the trial copying flat FT is reset to 0 at a step SP15. Although copying processing based on the trial multi-mode is effected at step SP16, the copying function itself is not particularly different from the normal copying function.

At step SP17, judgement is made as to whether or not the passing of a trailing end of a copied sheet is detected by the discharge sensor 35 (FIG. 2). If the passing thereof is not detected, paper jamming treatment is effected at steps SP18 and SP19. More specifically, at the step SP18, if the copied sheet does not pass the discharge sensor 35 within the predetermined period of time set by the jam detection timer, the state is judged to be jamming, and at the step SP19, the apparatus is shut down and the heater for the fixing system is turned off, with simultaneous indication for jamming by illumination in the operating system.

A step SP20 is intended for subtraction of the set number. In the normal copying, a subtraction signal for the counter is output, for example, upon termination of the scanning function. In the trial mode, subtraction is effected by the turning ON of the discharge sensor 35.

At a step SP21 to a step SP23, in the case where the sensor 100 is coupled to the copying apparatus 10, the trial copied sheet is discharged into the first bin 101 and the bins are advanced by one stage, in which state, the operator checks the copied sheet for its quality. If the copied sheet is not of the quality as desired, it is possible to reset the density, position, or magnification, etc. for corrections (the step SP1).

Steps from a step SP24 to a step SP26 are those for checking of the timer flag Ft, and the set condition of the timer for setting the time period $T_1$ from the discharge of the first sheet to starting of copying for the second sheet is confirmed. For arranging that the setting of the timer TM is effected only during the ON period of the discharge sensor 35, the state of rising thereof is judged at the step 24.

Meanwhile, a step SP27 or a step SP28 is provided for judging whether the print switch PSW42 or trial copy switch TSW43 is actuated during the timer set time period. Upon detection that the print switch PSW42 is turned ON at the step SP27, the timer TM is cleared at a step SP30 without waiting for the timer to count up, and at a step SP31, the timer flag Ft is reset so as to enter the copying processing subsequent to the first sheet (i.e. processing after the stage (II)), with the counter held in the state as it is subtracted (it is needless to say that the sheet member indicator 44 indicates the number as subtracted by 1). On the other hand, when the trial copy switch TSW43 is depressed during the time period set by the timer, the trial copy mode is again executed after the series of processings from a step SP32 to a step SP35 are effected (to be restored from the step SP35 to the step SP16).

For processings after the stage (III), the timer flag Ft is first reset at the step SP32, and thereafter, the first bin 101 of the sorter 100 is returned to a predetermined position (the step SP33). Simultaneously, the indication for the number of sheets in the sheet number indicator 44 is returned back to the number of copy sheets initially keyed-in (the step SP34), and then, the timer TM is cleared (the step SP35). Resetting of the timer TM is effected at the step SP25 after a stage (IV).

Upon termination (i.e. counting up) of the time period set by the timer TM, with judgements for NO at both of steps SP27 and SP28, the step is advanced to the step S 31 to reset the timer flag Ft for shifting to the copying functioning after the stage (II), which is of the continuous copying subsequent to the first sheet.

Figure 4C:
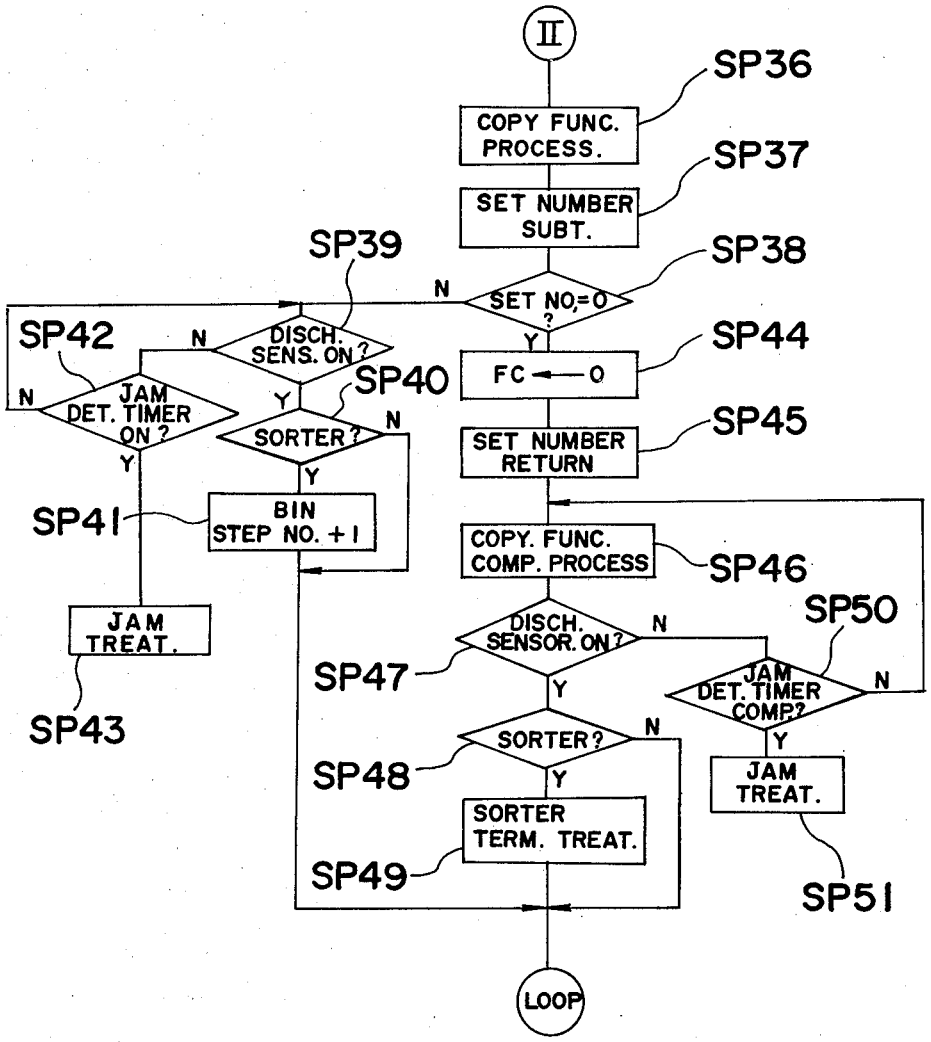

Steps SP36 to SP49 shown in FIG. 4(C) are processings in the ordinary copying mode. More specifically, following the processing (step SP36) for the copying function, the set number is subtracted one by one at a predetermined timing, and when the set number becomes 0 (YES at the step SP38), the copy flag FC is reset to 0 for making it possible to start the subsequent copying function, with simultaneous restoration of the set number (the step 45). The bins of the sorter 100 are advanced one stage by one stage (steps SP39 to SP41), everytime one copied sheet is discharged following the copying functon, until the set number becomes 0 (NO at the step SP38).

The steps SP42 and SP43, and steps SP50 and SP51 are steps for copying paper jamming, i.e. for jamming treatment, and are similar to the steps 18 and 19 described earlier. Although the trial multi-mode (or the multi-mode) is terminated in the above described manner, the series of processings are completed after effecting the termination treatment for the sorter 100 at the step SP49. The sorter termination treatment at the step SP49 referred to above is the treatment mainly related to returning the sorter 100 back to the initial state, etc. after the copied sheet has entered the last bin (i.e. the last bin as counted from the uppermost bin corresponding to the number of sheets preliminarily set). Almost all the processings shown in the flow-charts described so far are effected by the micro-computer MC contained in the control system 50 of the copying apparatus 10 illustrated in FIG. 2, while the functionings indicated in the flow-charts are arranged to be preliminarily memorized in the random access memory RAM or read only memory ROM by suitable programming languages.

Figure 5:
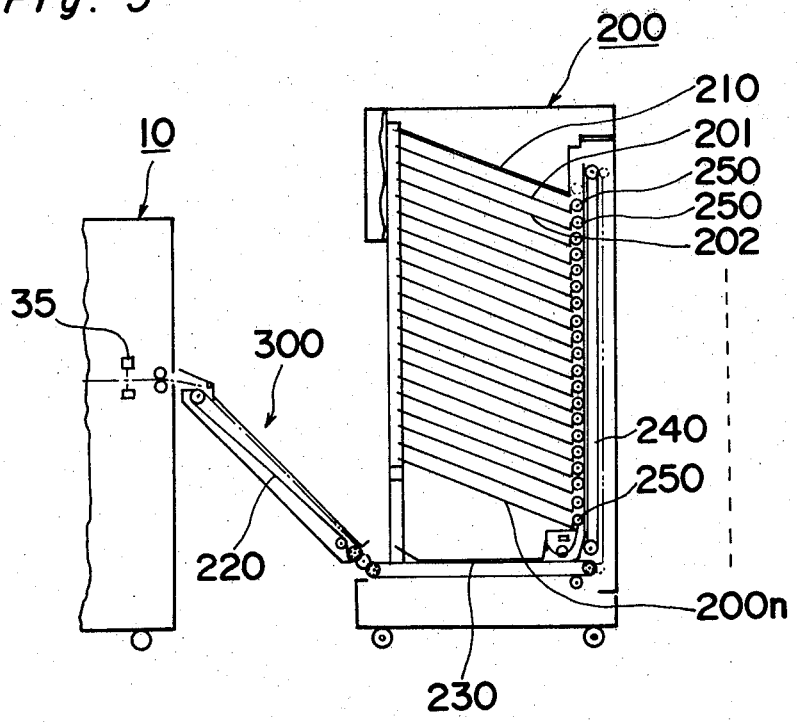
FIG. 5 is a schematic side elevational view, partly broken away, of a copying apparatus system to which a copying control arrangement according to a second embodiment of the present invention may be applied.
Figure 6A:
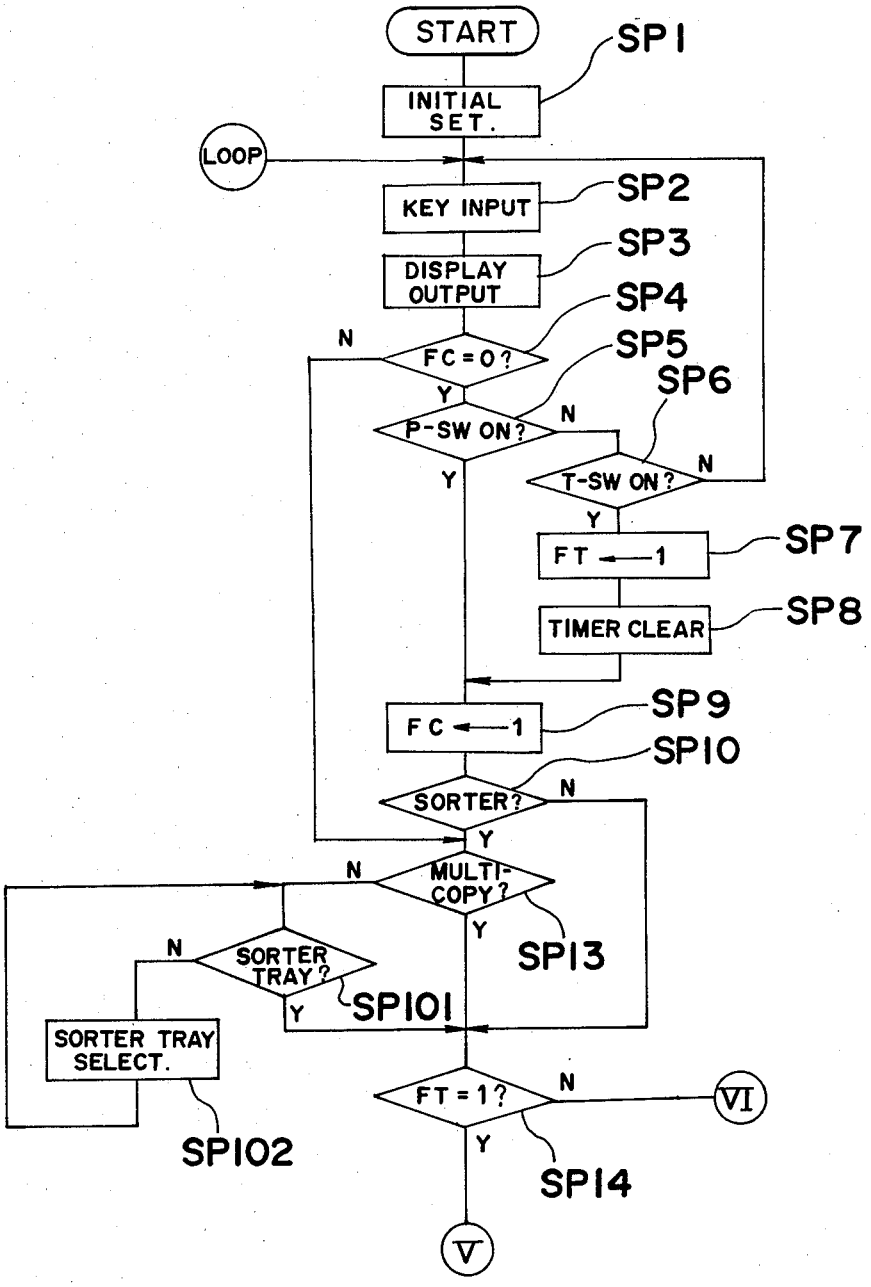
FIGS. 6(A) to 6(C) are flow charts explanatory of copying control in the copying apparatus system in FIG. 5.
Figure 6B:
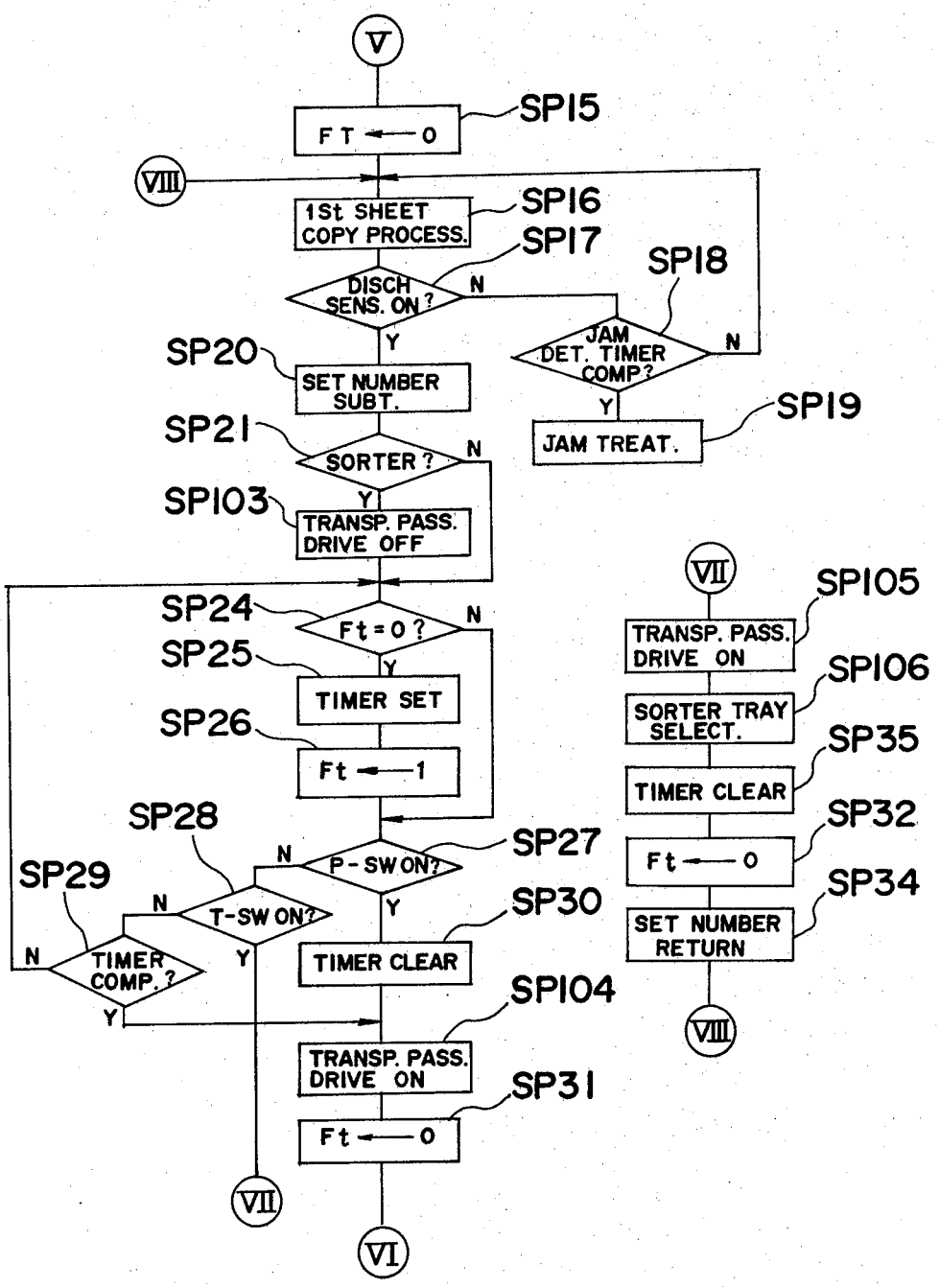
Figure 6:
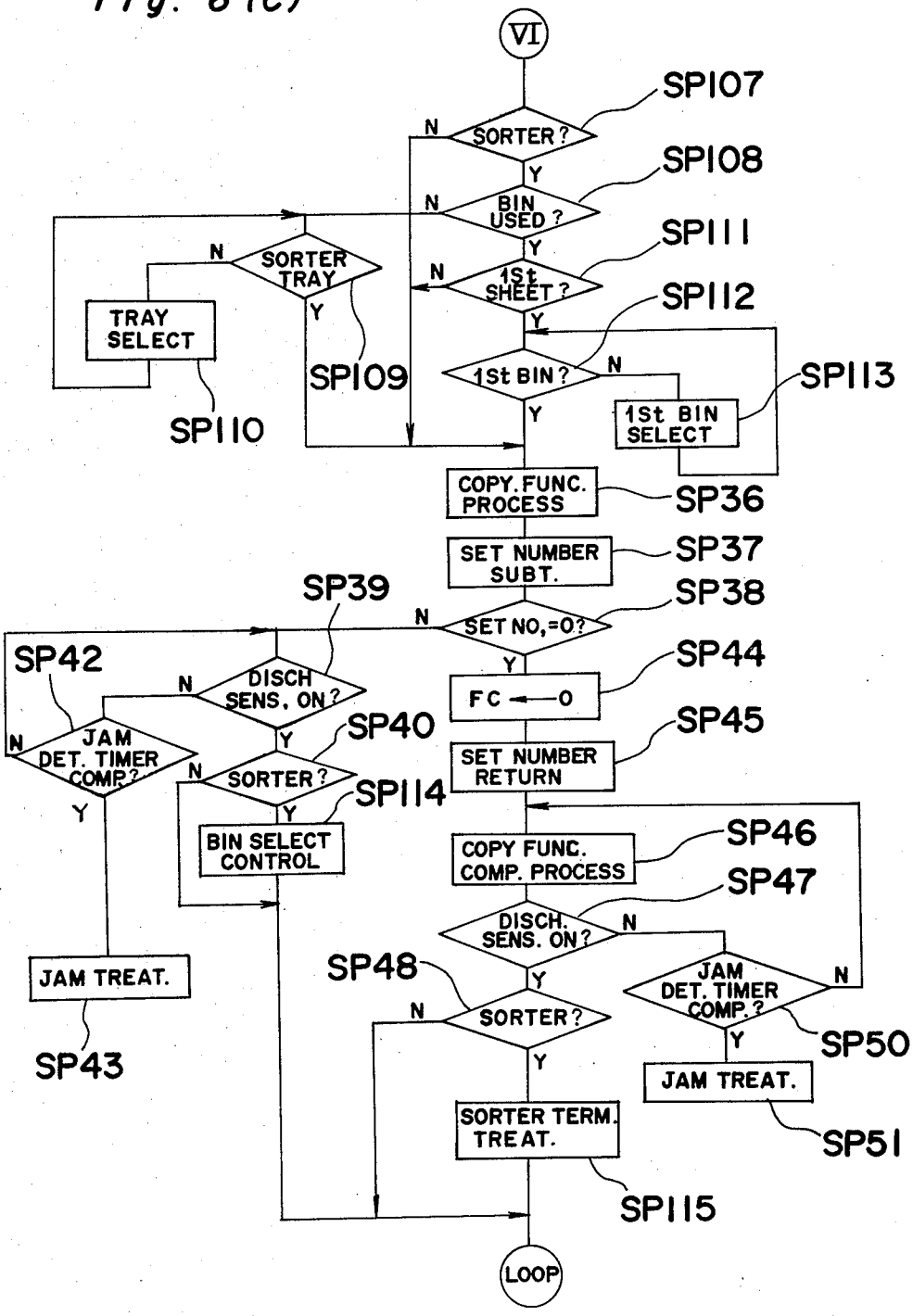

Reference is made to FIG. 5 showing another copying apparatus system to which the copying control arrangement according to a second embodiment of the present invention may be applied, and also to FIG. 6 showing a flow-chart of copying control for the copying apparatus system in FIG. 5.

It is to be noted here that the copying apparatus system of FIG. 5 is different from that in FIGS. 1 and 2 only in that, the sorter 100 in the first embodiment is replaced by a sorter 200, and the fundamental construction thereof is generally similar to that as represented by the block diagram of FIG. 3.

In the embodiment of FIGS. 5 and 6, the trial copy mode is applied to a copying apparatus system in which a copy paper transport passage 300 is provided between the copying apparatus 10 and the sorter 200.

Different from the sorter 100 of FIGS. 1 and 2, the sorter 200 of general purpose type has fixed bins 201, 202, . . . and **200*n*, and is so arranged that the copied sheets discharged from the apparatus 10 are successively fed upwards through the transport passage 300 including a train of endless belts 220, 230 and 240 each movably supported by a plurality of rollers, and leading from the discharge opening of the apparatus 10, to the lower portion of the sorter 200, and then, upwardly along end portion of the bins 201, 202, . . . and 200*n* at the right in FIG. 5, during which period, the copied paper sheets are classified into the respective bins 201, 202, . . and 200*n* by selective protrusion or retraction of guide members 250 movably provided at the end portion of each of said bins, while a tray 210 is provided at the uppermost portion (i.e. above the first bin 201**) for utilization of the copying apparatus even when the sorter operation is not necessary.

It should be noted that, in FIG. 5, the sorter 200 and the transport passage 300 are illustrated to be independent of each other as in the type generally employed, the sorter may be of a type having the transport passage integrally provided therein as one unit, and also that a sorter provided with a transport passage and capable of coupling with any types of copying apparatuses now commercially available.

The second embodiment of the present invention relates to FIGS. 5 and 6 is different from the first embodiment in that control is effected in such a manner that the copied sheet prepared by the predetermined copying function through actuation of the trial copying switch TSW43 is once stopped on the transport passage 300 for visual examination of the state of the copying thereat. Upon detection of the trailing end of the copied sheet by the discharge sensor 35 provided at the discharge opening of the copying apparatus 10 or after lapse of a minor period of time subsequent to the above detection, the timer TM within the micro-computer MC is actuated. The operator checks the copied sheet on the transport passage 300 for quality and carries out necessary corrections. If the trial copying switch TSW43 is operated before counting-up of the timer TM, the copied sheet on the transport passage 300 becomes unnecessary and therefore, is discharged onto the tray 210 at the uppermost stage of the sorter 200. Simultaneously, the timer TM is reset, with restoration of the set number, and functioning for preparing the copied sheet treated for correction is started. If the trial copying switch TSW43 is operated before counting up of the timer TM, a copied sheet repeatedly corrected may be obtained in the similar manner as in the first embodiment. Meanwhile, upon operation of the print switch PSW42, the copied sheet on the transport passage 300 is controlled to be discharged into the first bin 201 of the sorter 200, and copying and sorting processings subsequent to the first sheet are continuously effected, and when both of the switches 42 and 43 are not operated before the timer TM counts up, copying processing and sorting processing subsequent to the first sheet are automatically continued.

Reference is made to FIGS. 6(A) to 6(C) showing the functionings for the above processings in detail, in which like steps in FIGS. 4(A) to 4(C) are represented by similar step numbers, with detailed description thereof abbreviated for brevity.

In FIG. 6(A), a series of steps SP13, SP101 and SP102 relate to control for selecting a tray 210 of the sorter 200 when the sorting is not required at the sorter 200 (particularly in the single mode, etc.), while at steps SP21 and SP103 (FIG. 6(B)), processing to stop the first copied sheet on the transport passage 300 in the trial copy mode is executed, if the sorter 200 is coupled to the copying apparatus 10.

Steps SP27, SP28, SP29, SP30, SP104 and SP31 relate to processings when the print switch PSW42 is depressed during the time period set by the timer, and are arranged to drive the transport passage 300 again so as to feed the copied sheet into the sorter 200 and clear the timer TM for resetting the timer flag Ft to 0. In the above case, the first bin is selected in the sorter 200 when the bins thereof are to be used.

In a series of steps SP28, SP105, SP106, SP35, SP32, and SP34, there are shown processings when the trial copying switch TSW 43 is depressed during the time period set by the timer, and the transport passage 300 is driven again to feed the copied sheet into the sorter 200, with the timer TM cleared. The timer TM is reset at the step SP25. In the above case, the tray 210 is selected at the sorter 200.

In steps SP108, SP109 and SP110, it is possible to select the employment of the bins 201, 202, . . . and 200*n* or mere discharge of the copied sheet onto the tray 201.

On the other hand, in a series of steps SP111, SP112, and SP113, control is effected in such a manner that, when the bins are to be employed, the first sheet is guided into the first bin 201 whether the mode is of the trial copy mode or ordinary multi-mode.

It should be noted here that, in the second embodiment described so far, the timing in which the discharge sensor 35 is turned ON upon discharge of the copied sheet from the copying apparatus 10 does not coincide with the timing when said copied sheet enters the predetermined bin. Therefore, in the bin selection control at a step SP114, delay control is also included. Meanwhile, the sorter termination treatment at a step 115 is effected in the similar manner, and either the first bin 201 or the tray 210 is automatically selected finally. The above selection may be arranged to be effected at the initial setting of the step SP1.

It should be noted here that in both of the first and second embodiments described in the foregoing, if any of the print switch PSW42 and trial copying switch TSW43 is not operated during the time period set by the timer and the multi-mode functioning is desired to be suspended, control is effected to perform the predetermined stopping processing upon operation of a clear key 452 (FIG. 3). In the flow-charts, the operation of the above clear key 452 is abbreviated.

Figure 7:
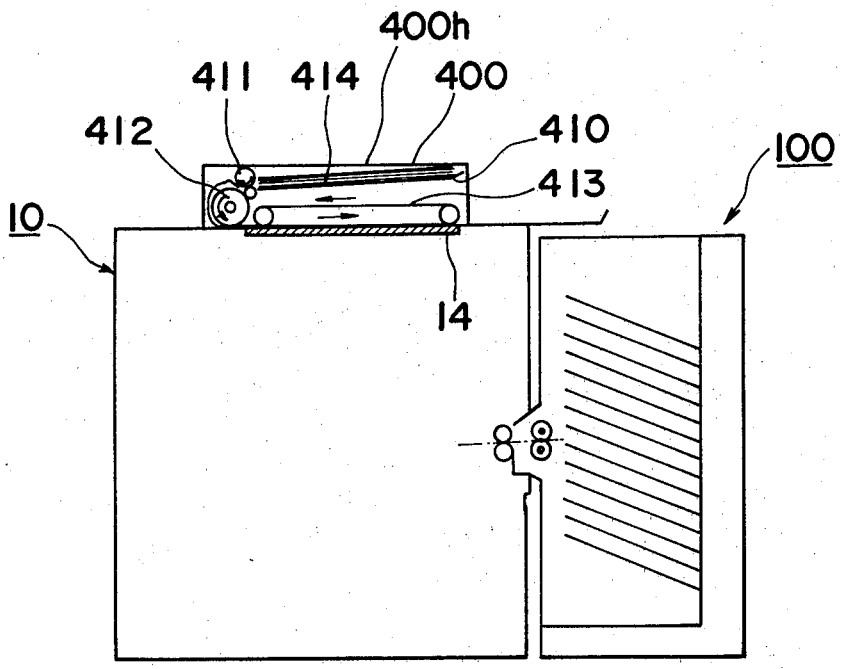
FIG. 7 is a schematic side elevational view of a copying apparatus system equipped with an automatic original document feeding device to which the first or second embodiment of the present invention may be applied.

Referring to FIG. 7, there is shown a copying apparatus system equipped with an automatic original document feeding device 400, to which the copying control arrangement according to both of the first and second embodiments described so far may be applied.

The automatic original document feeding device 400 of a known construction is mounted on the upper portion of the copying apparatus 10 in a position above the original document platform 14, and includes a housing 400*h*, an original document tray 410 provided at the upper portion in the housing 400*h* for supporting thereon a plurality of original documents 414 in a stack, a set of original feeding rollers 411, a transport roller 412, and an endless belt 413 movably supported by a plurality of rollers in a position directly above the platform 14. The plurality of documents 414 placed on the tray 410 are successively fed, one sheet by one sheet, onto the platform 14 through the feeding rollers 411, transport roller 412, and the endless belt 413 so as to be set in a predetermined position on said original document platform 14.

In the above arrangement in which the multi-mode function is effected with respect to one original document and said original document is discharged upon termination of said function (set number=0) for feeding-in a subsequent original document, control system may be so arranged that the completion signal of the above feeding-in function is employed instead of operation of the print switch PSW42, and that, for continuously copying a large number of original documents, the trial copying is effected only with respect to the first original document, with the ordinary multi-mode being effected thereafter, or that the trial copy mode is caused to function for each one original document.

It is to be noted here that, although the original document automatic feeding device 400 is a device for feeding the original document completely automatically, the situation is exactly the same even for an original feeding device of a type in which the original document is automatically set on the original platform through manual insertion thereof.

As is clear from the foregoing description, it is arranged that, in the continuous copying mode, the copying functions subsequent to the first sheet are continuously effected after lapse of a time period set by the time limiting means subsequent to discharge of the first copied sheet. There is provided a switch means for initiating the trial multi-mode which immediately starts the copying function subsequent to the first sheet upon actuation of the ordinary print switch during the set period of time so as to effect copying control. It is also possible to rationally carry out the necessary corrections after review of the first copied sheet in the case where copying is executed by the continuous copying mode, and thus, the quality of all the copied sheets may be maintained in an extremely favorable condition. Moreover, in the combination of the copying apparatus with a sorter, copied sheets at high quality may be obtained in a collated state, with the troublesome procedure for effecting repeated copying operations for the faulty copies being advantageously eliminated. Furthermore, in the copying apparatus system equipped with the automatic original document feeding device, a completely automatic operation is achieved in which checking is required only with respect to the first original document without the necessity of human supervision in the subsequent processes and yet, collated copies of desired quality may readily be obtained.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In a copying apparatus having a multi-copying mode for effecting a continuous copying function in correspondence with numerical values preliminarily set therein, a control arrangement for controlling functioning of said copying apparatus which comprises;

a first switching means for starting ordinary copying functioning, a second switching means for causing the copying apparatus to function in a trial copy mode, a timer means for starting a subsequent copying function after a lapse of a predetermined period of time subsequent to termination of an initial copying functioning when the copying functioning is executed in the trial copy mode, and a control means for starting the ordinary copying functioning selectively by a time-up signal of said timer means or by start signal from said first switching means during timer functioning of said timer means.

2. A control arrangement as claimed in claim 1, wherein said control means further controls said copying apparatus so as to start the copying functioning again in the trial copy mode when said second switching means is actuated during the timer functioning of said timer means.

3. A control arrangement as claimed in claim 1, further including a counter means which executes a counting functioning at each copying functioning, said counter means being controlled by said control means so as to be set in a state where copying of one sheet was executed by the copying functioning for a first sheet when the copying functioning is executed in said trial copy mode, and thereafter, to effect the counting functioning subsequent to the first sheet when the copying functioning is started selectively by the time-up signal of said timer means or by the start signal of said first switching means during the timer functioning of said timer means, and also, to be reset back to a state prior to the execution of the copying functioning upon actuation of said second switching means during said timer functioning.

4. In a copying apparatus having a multi-copying mode for effecting a continuous copying function in correspondence with numerical values preliminarily set therein, and coupled with a sorter for collating copy paper sheets after completion of the copying into stacks, a control arrangement for controlling the functioning of said copying apparatus and said sorter which comprises, a first switching means for starting an ordinary copying functioning, a second switching means for causing the copying apparatus and the sorter to function in a trial copy mode, a timer means for starting a subsequent copying function after lapse of a predetermined period of time subsequent to termination of the copying functioning when the copying apparatus and the sorter function in the trial copy mode, and a control means which controls said copying apparatus to start the ordinary copying functioning selectively by time-up signal of said timer means or by start signal from said first switching means during functioning of said timer means, and which also controls said sorter so as to lead a first copied sheet by said trial copy mode into a particular bin of said sorter.

5. A control arrangement as claimed in claim 4, wherein said control means further controls said copying apparatus and said sorter so as to start the copying functioning again in the trial copy mode when said second switching means is actuated during timer functioning of said timer means, and to lead the copied sheet obtained thereby into said particular bin of said sorter.

6. A control arrangement as claimed in claim 4, wherein said control means further controls said copying apparatus and said sorter so as to lead the copied sheet obtained by said trial copy mode into a first bin of said sorter when the copying functioning is executed by the trial copy mode, and thereafter, upon starting of the copying functioning selectively by the time-up signal of said timer means or by the start signal from said first switching means during the timer functioning, to successively lead copied sheets obtained thereby into bins of said sorter subsequent to the first bin thereof, and also, to lead copied sheets again into the first bin of said sorter, upon starting of the copying functioning by the signal from said second switching means during the timer functioning of said timer means.

7. In a copying apparatus having a multi-copying mode for effecting a continuous copying function in correspondence with numerical values preliminarily set therein, and coupled, through a transport passage, with a sorter for collating copy paper sheets after completion of the copying into stacks, a control arrangement for controlling functioning of said copying apparatus and said sorter which comprises;

a first switching means for starting ordinary copying functioning, a second switching means for causing the copying apparatus and the sorter to function in a trial copy mode, a timer means for starting subsequent copying function after lapse of a predetermined period of time subsequent to termination of copying functioning when the copying apparatus and the sorter function are in the trial copy mode, and a control means which controls said copying apparatus and said sorter in such a manner as to once stop the copied sheet obtained by the trial copy mode on the transport passage between said copying apparatus and said sorter, and also, to start the ordinary copying function and transportation of the copied sheet stopping on said transport passage, selectively by the time-up signal of said timer means or by the start signal from said first switching means during the timer functioning of said timer means.

8. A control arrangement as claimed in claim 7, wherein said control means further controls said copying apparatus and said sorter so as to start the copying functioning again in the trial copy mode when said second switching means is actuated during timer functioning of said timer means, and also, to lead the copied sheet stopping on said transport passage onto a particular tray of said sorter.

9. A control arrangement as claimed in claim 7, wherein said control means further controls said copying apparatus and said sorter in such a manner as to lead a first copied sheet stopping on said transport passage into a first bin of said sorter and to lead copied sheets subsequent to the first sheet successively into subsequent bins of said sorter upon starting of the copying functioning selectively by the time-up signal of said timer means or by the start signal from said first switching means during the timer functioning of said timer means, and further, upon starting of the copying functioning by the signal from said second switching means during the timer functioning of said timer means, to lead the first copied sheet stopping on said transport passage onto the particular tray of said sorter and also, to again stop the second copied sheet on said transport passage.

* * * * *